United States Patent [19]

Bachofer

[11] 3,968,819

[45] July 13, 1976

[54] DRUM FILLING DEVICE

[75] Inventor: Henry L. Bachofer, Newtown Square, Pa.

[73] Assignee: Sun Oil Company of Pennsylvania, Philadelphia, Pa.

[22] Filed: Apr. 11, 1975

[21] Appl. No.: 567,447

Related U.S. Application Data

[63] Continuation of Ser. No. 423,343, Dec. 10, 1973, abandoned.

[52] U.S. Cl. ..... 141/155

[51] Int. Cl.[2] ..... B65B 43/42; B65B 57/00

[58] Field of Search ..... 53/77; 141/129, 138, 141/155–157, 163, 181, 183, 283, 346, 97; 198/19

[56] References Cited

UNITED STATES PATENTS 2,128,735 8/1938 Schmidt ..... 141/181 X 3,181,575 5/1965 Krizka ..... 141/181 X

*Primary Examiner*—Richard E. Aegerter
*Assistant Examiner*—Frederick B. Schmidt
*Attorney, Agent, or Firm*—J. Edward Hess; Donald R. Johnson; Gary V. Pack

[57] ABSTRACT

An improved apparatus for filling drums, for example oil drums wherein a drum is advanced to a filling station via a conveyor belt, a filling nozzle is inserted into the fill hole of the drum, the drum is filled, the nozzle removed and the conveyor advanced, which includes a safety switch preventing advancement of the conveyor belt until the filling nozzle is completely removed from the fill hole thereby preventing structural damage to the filling equipment.

2 Claims, 5 Drawing Figures

DRUM FILLING DEVICE

CROSS REFERENCE TO RELATED APPLICATIONS

This application is a Continuation of the copending application having the same title, Ser. No. 423,343, filed Dec. 10, 1973, now abandoned.

BACKGROUND OF THE INVENTION

1. Field of the Invention

This invention relates to an improved apparatus for filling drums such as oil drums. More particularly, it relates to a safety system which prevents damage to existing filling equipment by preventing removal of a drum from a filling station until the filling equipment has been disengaged therefrom.

2. The Prior Art

A drum filling procedure, such as is used to fill oil drums, usually consists of the following steps:

a. positioning a drum under a filling nozzle with a chain conveyor and hand manipulation b. lowering a nozzle into the drum fill opening c. starting the filling procedure and filling the drum, usually by weight d. raising the nozzle clear of the drum e. actuating the conveyor to remove the filled drum and to deliver an empty drum and f. installing a cap and cover on the filled drum, usually manually.

This procedure involves a risk that the operator will mistakenly energize the chain conveyor to remove the filled drums before the filling nozzle is clear of the drum fill hole and serious structural damage to the equipment will result. Also, a risk of operator injury exists.

A safety device and filling procedure utilizing it is now put forth to prevent this type of accident and remove this drawback from present-day filling operations.

SUMMARY OF THE INVENTION

The present invention provides an apparatus for filling drums, preferably oil drums, wherein a safety switch is actuated by the insertion and removal of the fillpipe in a drum filling system. A toggle-type sealed switch is mounted on the filling apparatus in such a way that it closes an electrical circuit in the conveyor circuit only when the retractor handle is completely raised and the filling nozzle is completely removed from the drum fill hole.

As a result, the operator cannot actuate the chain conveyor which removes the drum until the fillpipe is completely removed. The advantages of such a system include inter alia avoidance of unnecessary liquid spills, protection of equipment, with consequent avoidance of costly repair and downtime, and avoidance of possible operator injury.

These and other advantages will be more readily apparent upon review of the drawings and the preferred embodiment which follows.

DESCRIPTION OF THE DRAWINGS AND THE PREFERRED EMBODIMENT

FIG. 1 shows the fillpipe disengaged and FIG. 2 shows the fillpipe engaged.

Figure 1:
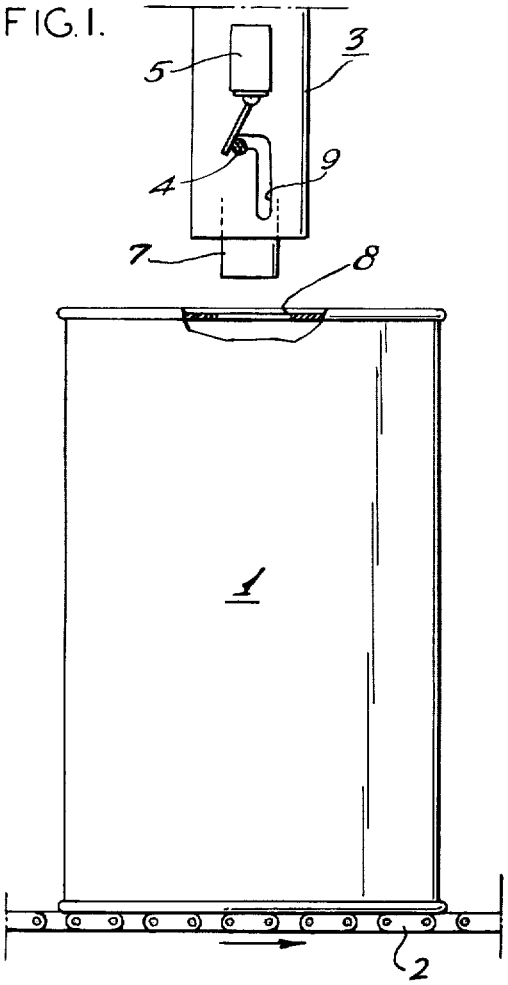
FIGS. 1 and 2 show the switch of the present invention as it can be mounted on a retractable fillpipe device.
Figure 2:
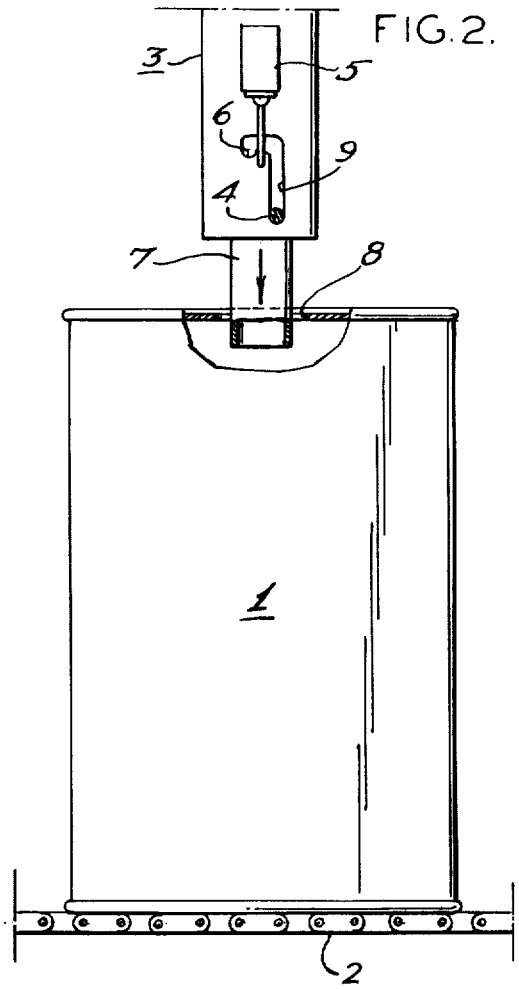

FIGS. 1 and 2 show a drum 1 on a chain conveyor 2 at the filling position below the filling assembly 3. Mounted on the filling assembly are the retractor handle 4 which slides in the L-shaped notch 9, and the switch 5. In FIG. 1, the switch is in a closed position due to the restraint of the retractor handle 4 being placed in the detent 6. In this position, power can be supplied to the chain conveyor motor (not shown). In FIG. 2 the fillpipe 7 has been engaged by lowering handle 4 in slot 9 and inserted into the fill hole 8 of the drum 1. The retractor handle has been moved out of the detent and down the slot thereby engaging the retractable fillpipe to which it is attached. As a result, the open-biased switch 5 has returned to its normal open position and the power to the conveyor motor is cut off.

Figure 3:
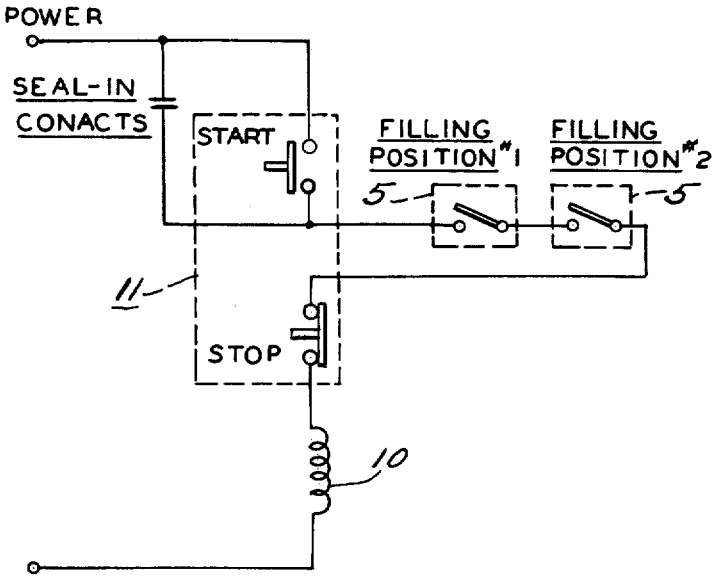
FIG. 3 shows an electrical control circuit for the conveyor drive including the switch circuit of the present invention. For the sake of simplicity, only two filling positions are provided for and it is noted that the same system can be used in a series of any number of filling positions.
Figure 4:
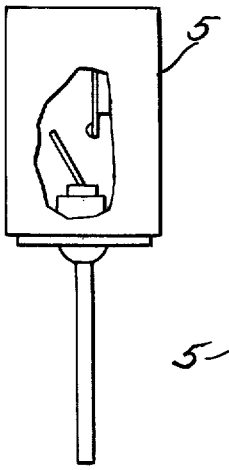
FIGS. 4 and 5 show schematically the switch in open and closed positions.
Figure 5:
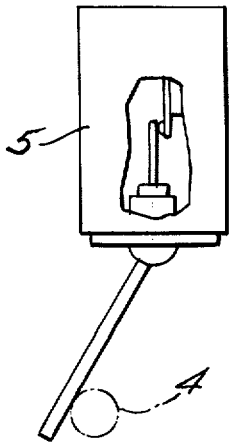

The operation of the switch in the conveyor power circuit can be better understood with reference to FIGS. 3, 4 and 5. In FIG. 3 a power circuit for a double fill assembly conveyor belt is shown. The switch 5 is in the line in series with the motor contactor 10 and its stop-start control 11, both of conventional configuration. As can be seen, as long as the retractor handle is not in the detent, the power cannot be supplied to operate the conveyor motor. FIGS. 4 and 5 schematically show the corresponding positions of the switch post and the electrical circuit. The preferred switch is a random motion actuator type with a flexible post or actuator which makes the circuit when moved away from its normal position in any direction.

Only when the operator has completely disengaged the fillpipe and the retractor handle is back in the detent can the conveyor motor be activated to remove the drum from the filling position. As a result, the equipment damage and risk of accident which exist in the prior art filling systems are avoided.

The invention claimed is:

1. An apparatus for filling a drum with liquid and for preventing the removal of the drum until the filling apparatus has been completely removed from the drum, comprising:

a. a source of liquid, b. a filling assembly connected to the source of liquid comprising:

i. an outer pipe housing having an inverted notch with a detent section, ii. an inner fill pipe retractably mounted inside the outer pipe housing, and iii. a retractor handle passing through the notch in the pipe housing and secured to the fill pipe so that when the retractor handle is raised as far as the notch will allow, the fill pipe is completely withdrawn from the drum, c. means for removing the drum from its fill position beneath the filling assembly, and d. switching means having an actuator arm which has a normal position and an actuated position, said switching means mounted on the outside of the pipe housing so that when the retractor handle has been raised to its uppermost limits and rotated into the detent section of the notch, the actuator arm is deflected from its normal position to its actuated position, said switching means being connected to the drum removing means so that the removing means will not operate until the actuator arm is in its actuated position.

2. Apparatus recited in claim 1, wherein the normal position for the actuator arm on the switching means is the "break" mode and the actuated position is the "make" mode.

* * * * *